US008515321B2

(12) United States Patent
Kim et al.

(10) Patent No.: US 8,515,321 B2
(45) Date of Patent: Aug. 20, 2013

(54) TONER SUPPLY ROLLER FOR ELECTROPHOTOGRAPHIC IMAGING APPARATUS AND METHOD OF PREPARING THE SAME

(75) Inventors: Tae-hyun Kim, Hwaseong-si (KR); An-kee Lim, Yongin-si (KR); Hee-won Jung, Suwon-si (KR); Yong-hoon Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 335 days.

(21) Appl. No.: 12/879,112

(22) Filed: Sep. 10, 2010

(65) Prior Publication Data

US 2011/0158705 A1 Jun. 30, 2011

(30) Foreign Application Priority Data

Dec. 29, 2009 (KR) ..... 10-2009-0132787

(51) Int. Cl.
*G03G 15/08* (2006.01)

(52) U.S. Cl.
USPC ..... 399/281; 399/286

(58) Field of Classification Search
USPC ..... 399/272, 281, 286
See application file for complete search history.

(56) References Cited

U.S. PATENT DOCUMENTS

| | | | | |
|---|---|---|---|---|
| 6,776,745 | B2 * | 8/2004 | Nakashima et al. | 399/281 |
| 2005/0153222 | A1 * | 7/2005 | Sugimura | |
| 2007/0107225 | A1 * | 5/2007 | Kim | |

FOREIGN PATENT DOCUMENTS

| | | | |
|---|---|---|---|
| JP | 03020763 | A * | 1/1991 |
| JP | 04070781 | A * | 3/1992 |
| JP | 2003342481 | A * | 12/2003 |
| JP | 2006146249 | A * | 6/2006 |
| JP | 2008009215 | A * | 1/2008 |

* cited by examiner

*Primary Examiner* — Susan Lee
(74) *Attorney, Agent, or Firm* — Stanzione & Kim, LLP

(57) ABSTRACT

A toner supply roller of an electrophotographic imaging apparatus and a method of preparing the toner supply roller are provided. The toner supply roller includes a polyurethane foam, and a metal shaft inserted in the polyurethane foam along an axis thereof, wherein the polyurethane foam includes an ion-conductive agent and a binder, and the binder includes a resin having an amide bond. Accordingly, the toner supply roller including polyurethane foam provides an improved toner supply and prevents image defects.

8 Claims, 3 Drawing Sheets

TONER SUPPLY ROLLER FOR ELECTROPHOTOGRAPHIC IMAGING APPARATUS AND METHOD OF PREPARING THE SAME

CROSS-REFERENCE TO RELATED APPLICATIONS

This application claims priority under 35 U.S.C. §119 from Korean Patent Application No. 10-2009-0132787, filed in the Korean Intellectual Property Office on Dec. 29, 2009, the disclosure of which is hereby incorporated by reference in its entirety for all purposes.

BACKGROUND

1. Field of the Invention

The present disclosure generally relates to a toner supply roller of an electrophotographic imaging apparatus capable of improved toner chargeability and toner supply so that an image is produced with increased resolution, and to methods for preparing the same.

2. Description of the Related Art

An electrophotographic image forming apparatus such as a laser printer, a facsimile, or a copier generally employs a toner supply roll, a photosensitive medium, a charging roller, a developing roller, and a transfer roller formed around the photosensitive medium. With such an arrangement, a developing agent, supplied from a developing device, is transported by the voltage supplied to the photosensitive medium, the charging roller, the developing roller or the transfer roller, to form a predetermined image onto a printing medium. By way of an example, the charging roller charges a surface of the photosensitive medium with a predetermined voltage, on which surface an electrostatic latent image is formed when the charged surface is exposed to light modulated according to the print data that is emitted from a light exposure unit. The developing roller supplies developing agent to the photosensitive medium to visualize the electrostatic latent image into a developer image. The developer image is transferred by the transfer roller onto the printing medium passing between the photosensitive medium and the transfer roller.

The developing roller must have enough transfer characteristics and resiliency in order to contact the photosensitive medium and attach toner onto the electrostatic latent image. A non-magnetic mono-component developer is widely used to develop the electrostatic latent image. However, due to the difficulty in controlling the charge of the toner on the developing roller, problems such as non-uniform charge or unstable charging operation may occur. These problems may generate image defects such as ghosts. It is particularly difficult to obtain high quality images with high optical density in high temperature and humid environments.

SUMMARY

The disclosure provides a toner supply roller of an electrophotographic imaging apparatus made from a polyurethane foam that is capable of providing improved charge characteristics of toner and of high resolution images while preventing inefficient toner supply in a solid pattern operation. The disclosure also provides methods for preparing the toner supply roller disclosed herein.

According to one aspect the present disclosure, there is provided, for use in an electrophotographic imaging apparatus, a toner supply roller formed of a polyurethane foam; and a metal shaft inserted in the polyurethane foam along an axis thereof, wherein the polyurethane foam includes an ion-conductive agent and a binder, and wherein the binder includes a resin having an amide bond (—CONH—).

The resin having an amide bond may have a higher positive polarity electrification than polyurethane.

The resin having an amide bond may be a nylon resin.

The nylon resin may be selected from of NYLON 6, NYLON 6.6, NYLON 12, NYLON 11, and polyamide-imide, or a copolymer thereof.

The ion-conductive agent may be an organic salt selected from lauryl trimethyl ammonium salts, stearyl trimethyl ammonium salts, octadodecyl trimethyl ammonium salts, dodecyl trimethyl ammonium salts, hexadecyl trimethyl ammonium salts, modified aliphatic dimethylethyl ammonium salts, perchlorate salts, chlorate salts, hydrogen fluoroborate salts, ethosulfate salts, halogenated benzene salts, aliphatic sulfonate salts, higher alcohol sulfuric ester salts, higher alcohol ethylene oxide added sulfuric ester salts, higher alcohol phosphoric ester salts, higher alcohol ethylene oxide added phosphoric ester salts, higher alcohol ethylene oxide salts, polyethylene glycol aliphatic ester salts, and polyhydric alcohol aliphatic ester salts, or a combination thereof.

The ion-conductive agent may be selected from salts of the Group I ($Li^+$, $Na^+$, $K^+$, $Rb^+$, $Cs^+$, and $Fr^+$) and Group II ($Be^{++}$, $Mg^{++}$, $Ca^{++}$, $Sr^{++}$, $Ba^{++}$, and $Ra^{++}$) elements of the periodic table, complexes of metals selected from Group I and Group II elements of the periodic table with any one selected from 1,4-butandiol, ethylene glycol, polyethylene glycol, propylene glycol, and a polyethylene glycol, or a combination thereof.

The ion-conductive agent may be selected from $LiCF_3SO_3$, $LiAsF_6$, $LiBF_4$, $NaClO_4$, NaSCN, NaCl, KSCN, and $Ca(ClO_4)_2$.

The nylon resin may be present from about 5 parts per hundred (phr) to about 50 phr.

The ion-conductive agent is present from about 5 phr to about 30 phr.

According to another aspect the present disclosure, there is provided a method of preparing a toner supply roller of an electrophotographic imaging apparatus, comprising the steps of: a) preparing a polyurethane foam by immersing a filter foam in an impregnating solution; and b) inserting a metal shaft through a central portion of the polyurethane foam in an axis direction.

The filter foam may be prepared by mixing a premixed polyol with and isocyanate, wherein the premixed polyol includes a foaming agent, a surfactant, a catalyst, an ion-conductive agent and a polyol.

The impregnating solution may include a solvent, a binder and an ion-conductive agent.

The polyurethane foam may be prepared by immersing the filter foam in the impregnating solution, squeezing the filter foam and drying the filter foam to remove the solvent from the filter foam.

The resin having an amide bond may have a higher positive polarity electrification than polyurethane.

The resin having an amide bond may be a nylon resin.

The nylon resin may be selected from NYLON 6, NYLON 6.6, NYLON 12, NYLON 11 and polyamide-imide, or a copolymer thereof.

The ion-conductive agent may be an organic salt selected from lauryl trimethyl ammonium salts, stearyl trimethyl ammonium salts, octadodecyl trimethyl ammonium salts, dodecyl trimethyl ammonium salts, hexadecyl trimethyl ammonium salts, modified aliphatic dimethylethyl ammonium salts, perchlorate salts, chlorate salts, hydrogen fluoroborate salts, ethosulfate salts, halogenated benzene salts, aliphatic sulfonate salts, higher alcohol sulfuric ester salts, higher alcohol ethylene oxide added sulfuric ester salts, higher alcohol phosphoric ester salts, higher alcohol ethylene oxide added phosphoric ester salts, higher alcohol ethylene oxide salts, polyethylene glycol aliphatic ester salts and polyhydric alcohol aliphatic ester salts, or a combination thereof.

The ion-conductive agent may be selected from salts of the Group I ($Li^+$, $Na^+$, $K^+$, $Rb^+$, $Cs^+$, and $Fr^+$) and Group II ($Be^{++}$, $Mg^{++}$, $Ca^{++}$, $Sr^{++}$, $Ba^{++}$, and $Ra^{++}$) elements of the periodic table, complexes of metals selected from Group I and Group II elements of the periodic table with any one selected from 1,4-butandiol, ethylene glycol, polyethylene glycol, propylene glycol and a polyethylene glycol, or a combination thereof.

The ion-conductive agent may be selected from $LiCF_3SO_3$, $LiAsF_6$, $LiBF_4$, $NaClO_4$, NaSCN, NaCl, KSCN, and $Ca(ClO_4)_2$.

The nylon resin may be present from about 5 phr to about 50 phr.

The ion-conductive agent may be present from about 5 phr to about 30 phr.

Accordingly, the toner supply roller of an electrophotographic imaging apparatus according to embodiments of the present disclosure uses polyurethane foam which has a low cost and low hardness, which is capable of an improved toner chargeability, and which is capable of reducing the contamination of a non-image area problem during supplying of toner particularly in forming of a solid pattern.

BRIEF DESCRIPTION OF THE DRAWINGS

Various aspects of the present disclosure will be more apparent by describing certain embodiments of the disclosure with reference to the accompanying drawings, in which.

DETAILED DESCRIPTION OF THE EMBODIMENTS

Figure 1:
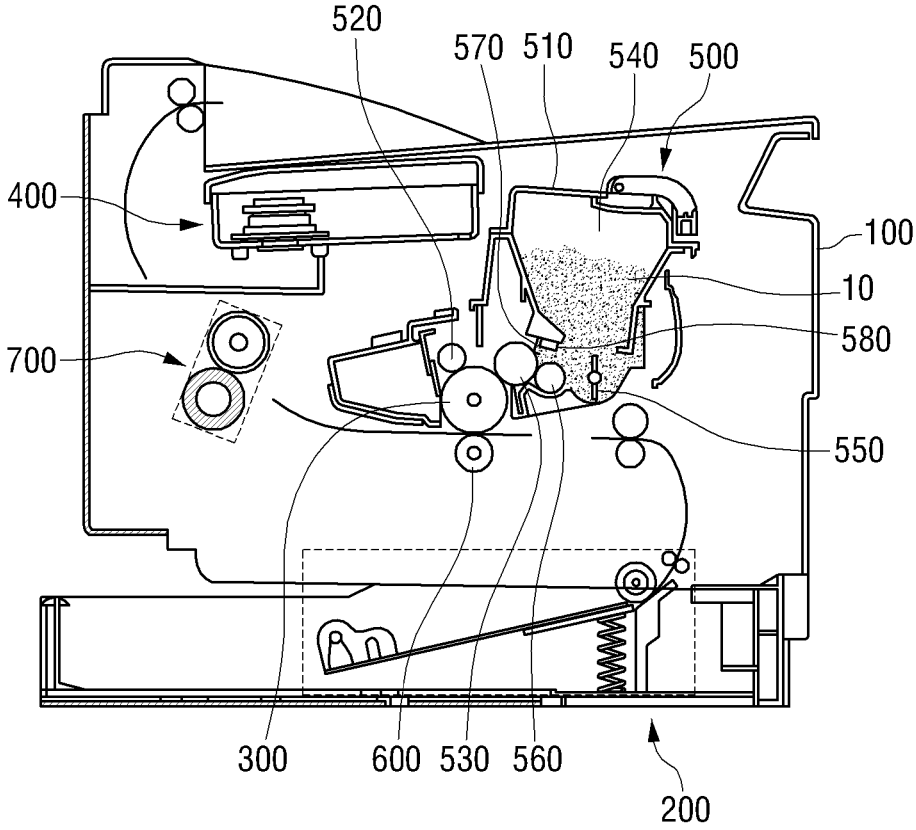
FIG. 1 illustrates an electrophotographic imaging apparatus employing therein a toner supply roller according to an embodiment of the present disclosure.

In the following description, the same drawing reference numerals are used for the same elements even in different drawings. The matters defined in the description, such as detailed construction and elements, are provided to assist in a comprehensive understanding of the disclosure. However, the disclosure can be carried out without those specific details. Also, well-known functions or constructions are not described in detail since they would obscure the disclosure with unnecessary detail.

FIG. 1 illustrates an electrophotographic imaging apparatus employing a toner supply roller. Referring to FIG. 1, a photosensitive body 300 is reactive to radiant energy such as, for example, light energy received from a light source. On the surface of the photosensitive body 300, which is charged by the charging roller 520 to a predetermined potential, a latent image may be formed by selective exposure to light. In order to visualize the latent image, a toner 10 is attached onto the latent image by a developing roller 530, which carries on its surface the toner 10 in such a manner that the toner 10 has constant chargeability and fixability, relative to the velocity difference between the developing roller 530 and toner layer regulating device 570. The toner supply roller 560 provides a first supply of toner 10 to the developing roller 530 using the difference in the relative velocity between the toner supply roller 560 and the developing roller 530. In this regard, although the toner fixability and chargeability may not be uniform, it may be preferable to ensure that a predetermined amount of toner 10 is supplied to the developing roller 530.

The toner supply roller 560 may generally be fabricated using a non-conductive material such as silicone, urethane foam and the like. The toner 10 is a consumable agent used for image developing processes, and may include a resin as the main component thereof. The toner layer regulating device 570 ensures that the toner 10 is attached in a constant amount and has a regular chargeability, using a difference of relative velocities between the toner layer regulating device 570 and the developing roller 530.

The charging roller 520 operates to charge the photosensitive body 300, and in an alternative embodiment may be replaced by a corona charging device. A cleaning blade made from a urethane rubber plate material may be provided in order to remove toner remaining unused from the photosensitive body 300. A laser scanning unit (LSU) 400 may irradiate light onto the surface of the photosensitive body 300 using a laser diode or the like, which causes a latent image to be formed on the surface of the photosensitive body 300. The toner 10 is relatively weakly attached onto the surface of the photosensitive body 300 due to the difference of surface potential, and may be transferred onto a paper sheet when the transfer roller 600 supplies electricity of opposite polarity.

Figure 2A:
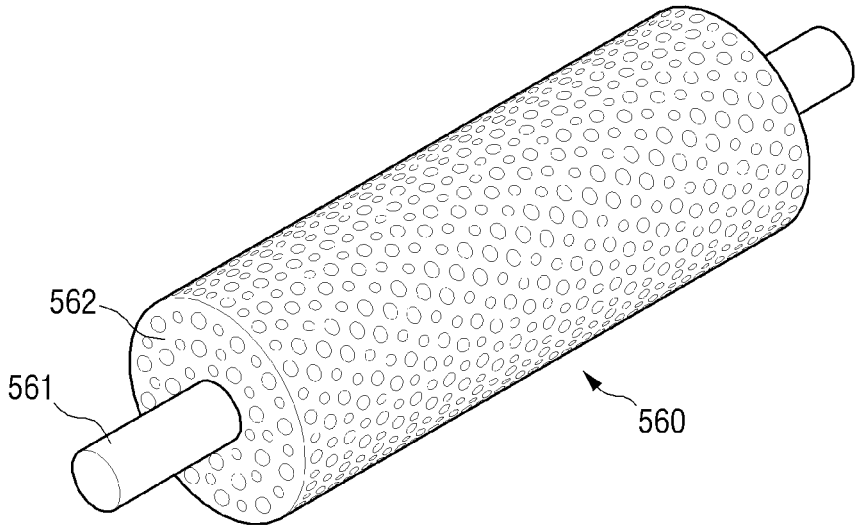
FIG. 2A illustrates a toner supply roller according to an embodiment of the present disclosure.
Figure 2B:
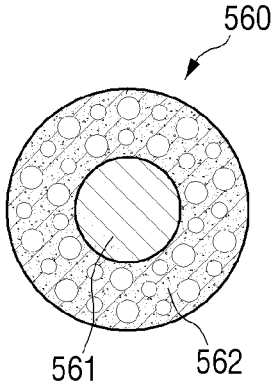
FIG. 2B is a cross sectional view of the toner supply roller of FIG. 2A.

Referring to FIGS. 2A and 2B, the toner supply roller 560 may include a shaft member 561 made from a metallic material and a polyurethane foam 562 provided on the shaft member 561.

Figure 3:
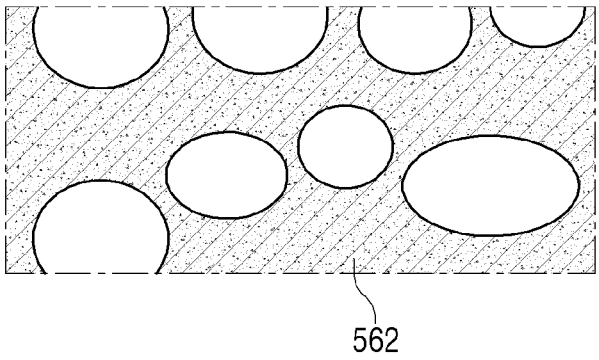
FIG. 3 illustrates an outer-most portion of a polyurethane foam of the toner supply roller of FIG. 2A.

Referring to FIG. 3, the polyurethane foam 562 may include open cells and walls. The polyurethane foam 562 having more open cells may provide better air transmittivity and higher efficiency of toner supply, and thus may produce a clearer image. The walls, that is, the remaining structure other than the open cells, of the polyurethane foam 562 may contain a binder and a conductive agent.

The toner supply roller 560 according to an embodiment of the present disclosure for use in an electrophotographic imaging apparatus may include a polyurethane foam and a metal shaft passing through the polyurethane foam in the axial direction, where the polyurethane foam may include a conductive agent having ionic-conductivity and a binder having an amide bond. The toner supply roller 560 can be considered as one of core components of a developing mechanism in an electrophotographic imaging apparatus, and may operate to provide a constant mass-to-charge ratio (Q/M) of toner through interoperation with the developing roller or with a doctor blade, which resets and recovers unused toner.

The toner supply roller includes a resilient layer that is usually made from a polyurethane foam, a silicone foam, or a brush. Although silicone foam provides good toner chargeability, it is relatively expensive. The difficulty in achieving low hardness also makes silicon foam less advantageous in terms of toner stress. A brush type provides good toner chargeability and toner supply, but is relatively more expensive than polyurethane or silicone foam, and has drawbacks such as torque from a developing device, formation of horizontal lines, and the like.

By contrast, polyurethane foam is relatively inexpensive, and is able to realize low hardness, but has a lower chargeability than the silicone foam or brush type. Polyurethane foam usually uses an electron-conductive agent, for example carbon black, as a conductive agent, and therefore, has a relatively weak resistance that affects the formation of electric field (ΔV) supply between the developing roller and the toner supply roller. As a result, the efficiency of toner supply may deteriorate, especially during the production of solid black images, which show image degradation such as fogging.

Considering the problems related to toner stress, low hardness polyurethane foam is preferred as the material for the toner supply roller of the imaging apparatuses that are particularly required to provide a high-speed operation or a long lifespan. Accordingly, it is desirable to resolve the described problems associated with the polyurethane foam to facilitate its use.

Many suggestions have been made to resolve the problems associated with the use of polyurethane foam. For example, one of the prior suggestions proposes to increase a nip area between the developing roller and the toner supply roller by increasing the outer diameter of the toner supply roller, and thus increasing the frictional chargeability of the toner. Another suggestion proposes to increase a frictional force by increasing the hardness of the polyurethane foam. Yet another suggestion proposes that air transmittivity may be increased by increasing the rate of open cells in the polyurethane foam, in order to improve the problem of foggy images. Yet another suggestion proposes that the number of open cells of the polyurethane foam may be increased to above 55 pores per inch (PPI) in order to prevent decrease of toner supply to the developing roller due to toner getting into the open cells. However, all these suggestions do not satisfactorily solve the problems associated with the toner supply roller using polyurethane foam.

The present disclosure addresses the problems related to the use of polyurethane foam for a toner supply roller. That is, different components are used as a binder and a conductive agent in the polyurethane foam, to thereby resolve problems of the toner supply roller such as insufficient toner chargeability, or inefficient toner supply particularly experienced in printing of solid color images such as, for example, a solid black.

A conductive agent having ionic-conductivity is included in the polyurethane foam of the toner supply roller according to an embodiment of the present disclosure. A conductive agent may generally be categorized as either an ion-conductive agent and an electronic-conductive agent. For example, the polyurethane foam of a conventional toner supply roller generally uses an electronic-conductive agent including, but not limited to, a conductive carbon black such as Katchen black or acetylene black; a conductive metal oxide such as oxidized carbon for ink, thermal-decomposition carbon, natural graft, artificial graft, tin oxide, titanium oxide, zinc oxide; metals such as silver, nickel, bronze, or germanium, and the like. Carbon black is used as a conductive agent due to its fine particle size and large structure. However, if polyurethane is manufactured by adding carbon black to polyol, and by allowing the polyol to react with isocyanate, the viscosity increases during the reaction that hinders formation of a foam and uniform cells. Accordingly, toner chargeability deteriorates, resulting in a background phenomenon in the produced image. Additionally, because the carbon black has a low resistance ($1.0\times10^3$ to $5.0\times10^4\Omega$), it can also affect the toner supply.

According to an aspect of the disclosure, a toner supply roller of an electrophotographic imaging apparatus may be provided to have a polyurethane foam and a metal shaft inserted in the polyurethane foam axially thereof, wherein the polyurethane foam includes an ion-conductive agent and a binder, and wherein the binder includes a resin having an amide bond.

To solve the problems related to the supply of toner, according to an aspect of the present disclosure a conductive agent having ionic-conductivity is provided. The ion-conductive agent may include, but is not limited to, one or more organic salts selected from lauryl trimethyl ammonium salts, stearyl trimethyl ammonium salts, octadodecyl trimethyl ammonium salts, dodecyl trimethyl ammonium salts, hexadecyl trimethyl ammonium salts, modified fatty acid-dimethylethyl ammonium salts, perchlorate, chlorate salts, hydrogen fluoroborate salts, ethosulfate salts, halogenated benzene salts, aliphatic sulfonate salts, higher alcohol ester sulfate salts, higher alcohol ethylene oxide added sulfuric ester salts, higher alcohol phosphoric ester salts, higher alcohol ethylene oxide added phosphoric ester salts, higher alcohol ethylene oxide salts, polyethylene glycol aliphatic ester salts, polyhydric alcohol aliphatic ester salts and the like.

The ion-conductive agent may also include salts of the Group I ($Li^+$, $Na^+$, $K^+$, $Rb^+$, $Cs^+$, and $Fr^+$) and Group II ($Be^{++}$, $Mg^{++}$, $Ca^{++}$, $Sr^{++}$, $Ba^{++}$, and $Ra^{++}$) elements of the periodic table, complexes of metals selected from Group I and Group II elements of the periodic table with any one selected from 1,4-butandiol, ethylene glycol, polyethylene glycol, propylene glycol and a polyethylene glycol, or a combination thereof. The salts of the Group I elements of the periodic table may include, but are not limited to, $LiCF_3SO_3$, $LiAsF_6$, $LiBF_4$, $NaClO_4$, NaSCN, NaCl, KSCN and the like, whereas the salts of the Group II elements of the periodic table may include, for example, $Ca(ClO_4)_2$ and the like.

The ion-conductive agent may be present within a range from about 5 phr to about 30 phr. If the ion-conductive agent is present in less than about 5 phr, a satisfactory conductivity may not be obtained. If more than 30 phr, the polyurethane foam may have deterioration of rebound resiliency, thereby possibly causing an image defect.

The toner supply roller may use a resin with an amide bond as a binder. If such resin is used, the negative chargeability of the toner is increased due to the positive-chargeability of the amide bond. A resin with an amide bond also has a higher positive polarity electrification than polyurethane. As a result, the amount of toner that can be attached onto the toner supply roller is increased, resulting in an enhanced efficiency of toner supply.

An example of a resin with an amide bond is a nylon resin, including but no limited to, one or more nylon resins selected from NYLON 6, NYLON 6.6, NYLON 12, nylon 11, polyamide-imide and the like. The term 'nylon resin' is used herein interchangeably with the term 'polyimide resin,' both terms referring to a thermoplastic resin containing an amide group (—CONH—). The nylon resin is also known as 'nylon' or 'polyimide,' and has characteristics including good mechanical properties, high resistance against fatigue, impact or solvent, and low-friction and reversible absorption of a minute amount of water. Examples of nylon resin include, but are not limited to, NYLON 6, NYLON 7, NYLON 9, NYLON 11, NYLON 12, NYLON 6.6, NYLON 6.10, NYLON 6.12, and the like. The numerical suffix with the term 'nylon' represents the number of carbon atoms of the monomers: the diamine first and the diacid second. Among the above examples of nylon resins, NYLON 6 and NYLON 6.6 are most widely known, and since the amide groups are separated by methylene groups, they are known as aliphatic polyamides. NYLON 6.6 is made of hexamethylene diamine and adipic acid; which gives NYLON 6.6 a total of 12 carbon atoms, and its name. NYLON 6 is made from carprolactam and has similar characteristics as NYLON 6.6. NYLON 6 begins as pure caprolactam, which has 6 carbon atoms and hence its name.

In order to prepare a toner supply roller, first, a premixed polyol including a foaming agent, a surfactant, a catalyst and an ion-conductive agent is mixed with isocyanate to form a semi-conductive polyurethane filter foam.

Polyols having two or more active hydrogens, and a compound having two or more isocyanate functional groups for the isocyanate may be used in the premixed polyol. For example, a polyol having two or more active hydrogens may be a polyether polyol, a polyester polyol, or a polyetherester polyol, each having terminal hydroxyl groups, or modified polyols such as acrylic modified polyols, or silicone modified polyols. The compound having two or more isocyanate groups may include, but is not limited to, toluene diisocyanate (TDI), 4,4-diphenylmethane diisocyanate (MDI), and the like, or a mixture or a modified compound thereof.

For the catalyst used in the preparation of the polyurethane foam, it may be appropriate to select a catalyst and adjust the amount used based on various factors such as foaming characteristics, reaction time, improvement of air transmittivity of the foam, and/or minimization of density differences. By way of example, an organic metal compound such as a tin compound, lead compound, iron compound, titanium compound, or amine compound may be used singly, or in combination with each other as the catalyst. In one example, a tertiary amine compound or a tin compound is the catalyst.

The foaming agent may be a low-boiling point material, including but not limited to, water, halogenated alkanes and the like. The halogenated alkane may include chlorosfluorocarbons, for example, trichlorofluoromethane, and the like.

The surfactant lowers the surface tension and thus, allows easier spreading, regulates the sizes of the generated bubbles, and provides stability to the foaming agent by regulating the cell structure of the polyurethane foam. The surfactant may include, but is not limited to, a silicone surfactant and the like. The amount of the surfactant may range from about 0.1 phr to about 5 phr with respect to the polyol. A surfactant used in less than about 0.1 phr may not provide the expected properties while on the other hand a surfactant used in more than about 5 phr may suffer from deterioration in its properties such as permanent compression strain ratio and the like.

The impregnating solution, including a solvent, a binder including a resin with an amide bond, and an ion-conductive agent therein, may be prepared separately. The impregnating solution allows the binder and the conductive agent to be included in the polyurethane foam. Accordingly, the binder and the conductive agent are included in the solvent, and are moved to the polyurethane foam. The solvent for the impregnating solution includes, but is not limited to, water, alcohols, ethers and the like. Since the solvent is removed after the binder and the conductive agent are moved into the polyurethane foam, the solvent should be easily removable, and should not change the properties of the binder, conductive agent, and/or polyurethane foam.

As explained herein, a nylon resin may be used as the binder. The binder may be used in an amount ranging from about 5 phr to about 50 phr, with respect to the impregnating solution. If the binder is used in an amount less than 5 phr, the binder may not provide sufficient fixability in the cell walls of the polyurethane foam while on the other hand, if the binder is used in an amount exceeding 50 phr, the binder may hinder recovery of the polyurethane foam. The filter foam may include about 80% of open cells, because more open cells may lead to a more efficient toner supply. As explained herein, the ion-conductive agent may be used as the conductive agent.

After the prepared semi-conductive polyurethane filter foam is dipped in the separately-prepared impregnating solution, the solvent may be removed by squeezing the filter foam with a roller. By drying the filter foam using a hot wind distributor such as an oven, a polyurethane foam having conductivity is prepared.

A metal shaft is passed through the center of the polyurethane foam in along the axial direction, and by grinding the outer portion of a block of the polyurethane foam, a conductive polyurethane toner supply roller having improved toner chargeability and background is prepared. However, any rod or shaft may alternatively be used, and is not particularly limited to a metal shaft. Further, any metal shaft or metal rod may also be used and is not particularly limited. The resulting polyurethane toner supply roller has low resistance, ranging from about $1.0\times10^5\Omega$ to about $9.0\times10^7\Omega$, which produces solid black images with the desired resolution. If resistance was higher, the produced solid black image may not have the desired resolution.

EXAMPLES

Example 1

A premixed polyol was prepared by adding 4 phr of water as a foaming agent, 1.5 phr of silicone as a surfactant, 0.2 phr of triethylenediamine (TEDA) as a catalyst, and 5 phr of a lithium complex as an ion-conductive agent, to a polyol including a mixture of 80 phr of polyester polyol (Korea Polyol Company Limited., GP-3000, hydroxyl value mg KOH/g54), and 20 phr of acryl polyol (Korea Polyol Company Limited, KE-848, Hydroxyl value mg KOH/g30). 105 phr of toluene diisocyanate (TDI) was added and the components were mixed and agitated at 2000 rpm. A semi-conductive slab foam was prepared at room temperature. (KE-848 is an AN copolymer polyol, and includes 20% of AN). The slab foam was put into a chamber and nitrogen and hydrogen were added to provide a filter foam having 80% or more open cell content.

An impregnating solution was prepared by adding 5 phr of nylon resin (Hyosung, 1101 BRT) and 5 phr of lauryl trimethyl ammonium salt (Nano Chem Tech) to 100 phr of ethanol solvent. The filter foam was immersed in the impregnating solution, and put in the roller for squeezing. The impregnated filter foam was put into a convection oven for 10 minutes at 130° C., the solvent was removed, and the dried polyurethane foam was prepared. The dried polyurethane foam was cut by a vertical cutter to 25×25×250 mm dimensions, and a 5.0 mm hole was bored through the central portion in a length-wise direction, and a metal shaft, which is 6.0 mm in diameter and wrapped by a hot melt sheet, was press-fit into the hole. The polyurethane foam was heated for 30 minutes at 120° C. in a convection oven so that the foam and the shaft are bonded to each other. The bonded polyurethane foam was ground by a grinder. By cutting both ends of the foam, the polyurethane foam toner supply roller, which was 13.7 mm in outer diameter and 220 mm in length, was obtained.

Example 2

The polyurethane foam toner supply roller of Example 2 was prepared in the similar manner as that of Example 1, except 20 phr of nylon resin was used.

Example 3

The polyurethane foam toner supply roller of Example 3 was prepared in the similar manner as that of Example 1, except 50 phr of nylon resin was used.

Example 4

The polyurethane foam toner supply roller of Example 4 was prepared in the similar manner as that of Example 1, except 20 phr of nylon resin and 20 phr of a lauryl trimethyl ammonium salt were used.

Example 5

The polyurethane foam toner supply roller of Example 5 was prepared in the similar manner as that of Example 1, except 20 phr of nylon resin and 30 phr of lauryl trimethyl ammonium salt were used.

Example 6

The polyurethane foam toner supply roller of Example 6 was prepared in the similar manner as that of Example 1, except 5 phr of lithium complex was used as an ion-conductive agent.

Comparative Example 1

The polyurethane foam toner supply roller of Comparative Example 1 was prepared in the similar manner as that of Example 1, except 3 phr of nylon resin was used.

Comparative Example 2

The polyurethane foam toner supply roller of Comparative Example 2 was prepared in the similar manner as that of Example 1, except 60 phr of nylon resin was used.

Comparative Example 3

The polyurethane foam toner supply roller of Comparative Example 3 was prepared in the similar manner as that of Example 1, except 20 phr of urethane resin (Korea Polyol Company Limited., NIXOL-R-9100) was used instead of nylon resin.

Comparative Example 4

The polyurethane foam toner supply roller of Comparative Example 4 was prepared in the similar manner as that of Example 1, except 3 phr of lauryl trimethyl ammonium salt was used.

Comparative Example 5

The polyurethane foam toner supply roller of Comparative Example 5 was prepared in the similar manner as that of Example 1, except 40 phr of lauryl trimethyl ammonium salt was used.

Comparative Example 6

The polyurethane foam toner supply roller of Comparative Example 6 was prepared in the similar manner as that of Example 1, except 20 phr of urethane resin (Korea Polyol Company Limited., NIXOL-R-9100) was used instead of nylon resin, and 20 phr of lauryl trimethyl ammonium salt was used.

A summary of the foregoing Examples and Comparative Examples is shown in Table 1. The unit of ingredient is phr in Table 1.

TABLE 1

| Impregnating Solution | Ex. 1 | Ex. 2 | Ex. 3 | Ex. 4 | Ex. 5 | Ex. 6 | Comp. 1 | Comp. 2 | Comp. 3 | Comp. 4 | Comp. 5 | Comp. 6 |
|---|---|---|---|---|---|---|---|---|---|---|---|---|
| Ethanol | 100 | 100 | 100 | 100 | 100 | 100 | 100 | 100 | 100 | 100 | 100 | 100 |
| Nylon Resin | 5 | 20 | 50 | 20 | 20 | 20 | 3 | 60 | — | 20 | 20 | — |
| Urethane Resin | — | — | — | — | — | — | — | — | 20 | — | — | 20 |
| Lauryl Trimethyl Ammonium Salt | 5 | 5 | 5 | 20 | 30 | — | 5 | 5 | 5 | 3 | 40 | 20 |
| Lithium Complex | — | — | — | — | — | 5 | — | — | — | — | — | — |

Tests

Evaluation of Toner Chargeability

The charge of toner was measured with respect to the toner on the toner supply roller based on Q/M meter.

Evaluation of Non-image Area Contamination

The non-image area contamination was measured by a densitometer. An image contamination occurs if the amount of toner charge was irregular or average charge amount was low, since the non-image area is developed by the toner. Specifically, density below 0.02 represents an 'excellent' level, and density below 0.03 represents an 'average' level. Accordingly, density below 0.03 was marked 'O', while density at or above 0.04 was marked 'X'.

Evaluation of Image Smear

The 'image smear' refers to a contamination of a non-image area of the produced solid pattern image, and the presence of this contamination was visually evaluated.

High-Temperature & High-Humidity Evaluation

This high-temperature and high-humidity evaluation involves mounting the supply roller on a toner cartridge, leaving the toner cartridge with the supply roller mounted thereon in an oven, and producing an image after seven days to determine if an image defect occurred. The toner supply rollers of Examples 1 to 6 and Comparative Examples 1 to 6 were put into an oven and left for 7 days at 25° C. and 55% humidity for the first day, at 40° C. and 90% humidity for the next 1.5 day, at 50° C. and 80% humidity for the next 2 days, at 40° C. and 90% humidity for the next 1.5 day, and at 25° C. and 55% humidity for the next 1 day. An image was then produced and examined for an image defect.

Evaluation of Supply in Solid Pattern Operation

The toner supply in the solid pattern operation was evaluated by producing and visually examining a purely black image. If the image shows decreased resolution, the toner supply may not be good.

Table 2 below lists the results of the described tests.

As shown in Table 2, the toner supply rollers of Examples 1 to 6 and Comparative Examples 2, 4 and 5 have more toner charge amounts. In other words, it is noticeable that the toner supply roller has the efficient toner supply, if nylon resin is used as a binder in the amount exceeding 5 phr in the polyurethane foam of the toner supply roller, as is the case of Examples 1 to 6 and Comparative Examples 2, 4 and 5.

As also shown in Table 2, the toner supply roller of Comparative Example 4 has a higher resistance, and this is understood to have been caused due to a relatively smaller amount of conductive agent used than in the other examples. Table 2 also shows that the toner supply roller of Comparative Example 5 had an image defect in the high-temperature/high-humidity evaluation, and this is understood to have been caused due to an excessive use of the conductive agent and subsequent deterioration of rebound resiliency of the polyurethane foam. In the high-temperature/high-humidity evaluation, the toner supply roller of Comparative Example 2 also showed image defect, and this is understood to have been caused due to excessive use of nylon resin used as a binder. Therefore, it is preferable that the ion-conductive agent included in the toner supply roller is present in a range from about 5 phr to about 30 phr.

As shown in the non-image area contamination evaluation, the toner supply rollers of Comparative Examples 1, 3, 4 and 6 had image contaminations in undesired areas, and had image smears. The image contaminations are understood to have been caused when the amount of nylon resin used as a binder is insufficient to function as the binder (as in the case of Comparative Example 1), when urethane resin is used as a binder instead of nylon resin (as in the case of Comparative Examples 3 and 6), or when the amount of the ion-conductive agent is insufficient (as in the case of Comparative Example 4). Accordingly, it is desirable to use an appropriate amount of binder resin and ion-conductive agent.

TABLE 2

| Test | Ex. 1 | Ex. 2 | Ex. 3 | Ex. 4 | Ex. 5 | Ex. 6 |
|---|---|---|---|---|---|---|
| Toner Chargeability (Q/M) | −25 | −30 | −33 | −29 | −29 | −25 |
| Resistance | 5.0E+07 | 5.0E+07 | 5.0E+07 | 2.0E+06 | 7.0E+05 | 5.0E+07 |
| Non-image Area Contamination | ○ | ○ | ○ | ○ | ○ | ○ |
| Image Smear | ○ | ○ | ○ | ○ | ○ | ○ |
| High-Temp/ High-Humidity Test | ○ | ○ | ○ | ○ | ○ | ○ |
| Solid Pattern Evaluation | ○ | ○ | ○ | ○ | ○ | ○ |

| Test | Comp 1 | Comp 2 | Comp 3 | Comp 4 | Comp 5 | Comp 6 |
|---|---|---|---|---|---|---|
| Toner Chargeability (Q/M) | −18 | −33 | −15 | −33 | −25 | −17 |
| Resistance | 5.0E+07 | 5.0E+07 | 5.0E+07 | 5.0E+08 | 5.0E+05 | 5.0E+06 |
| Non-image Area Contamination | x | ○ | x | x | ○ | x |
| Image Smear | x | ○ | x | x | ○ | x |
| High-Temp/ High-Humidity Test | ○ | x | ○ | ○ | x | ○ |
| Solid Pattern Evaluation | ○ | ○ | ○ | x | ○ | ○ |

In the solid pattern evaluation, the toner supply roller of Comparative Example 4 had an image defect due to insufficient use of the conductive agent. The toner supply rollers of Examples 1 and 6 both had good test results, although the two toner supply rollers used different types of ion-conductive agents. Accordingly, it is considered that there is no significant difference between using an organic salt or an inorganic salt as the ion-conductive agent.

As explained herein, the polyurethane foam toner supply roller has an improved toner supply and image quality, if an appropriate amount of binder and ion-conductive agent are included therein.

The foregoing embodiments and advantages are described as merely illustrative examples, and are not to be construed as limiting the full scope of the present disclosure. Aspects of the present disclosure can be readily applied to other types of apparatuses. It will be apparent to one of ordinary skill in the art that many alternatives, changes and variations of those embodiments specifically described herein are possible without departing from the principles and spirit of the invention, the scope of which is defined in the following claims and their equivalents.

What is claimed is:

1. A toner supply roller of an electrophotographic imaging apparatus comprising a polyurethane foam and a metal shaft inserted in the polyurethane foam along an axis thereof, wherein the polyurethane foam comprises an ion-conductive agent and a binder, and wherein the binder comprises a resin having an amide bond such that the resin has a higher polarity electrification than polyurethane.

2. The toner supply roller of claim 1, wherein the resin having an amide bond is a nylon resin.

3. The toner supply roller of claim 2, wherein the nylon resin is selected from of NYLON 6, NYLON 6.6, NYLON 12, NYLON 11 and polyamide-imide, or a copolymer thereof.

4. The toner supply roller of claim 1, wherein the ion-conductive agent comprises an organic salt selected from lauryl trimethyl ammonium salts, stearyl trimethyl ammonium salts, octadodecyl trimethyl ammonium salts, dodecyl trimethyl ammonium salts, hexadecyl trimethyl ammonium salts, modified aliphatic dimethylethyl ammonium salts, perchlorate salts, chlorate salts, hydrogen fluoroborate salts, ethosulfate salts, halogenated benzene salts, aliphatic sulfonate salts, higher alcohol sulfuric ester salts, higher alcohol ethylene oxide added sulfuric ester salts, higher alcohol phosphoric ester salts, higher alcohol ethylene oxide added phosphoric ester salts, higher alcohol ethylene oxide salts, polyethylene glycol aliphatic ester salts and polyhydric alcohol aliphatic ester salts, or a combination thereof.

5. The toner supply roller of claim 1, wherein the ion-conductive agent is selected from salts of the Group I ($Li^+$, $Na^+$, $K^+$, $Rb^+$, $Cs^+$, and $Fr^+$) and Group II ($Be^{++}$, $Mg^{++}$, $Ca^{++}$, $Sr^{++}$, $Ba^{++}$, and $Ra^{++}$) elements of the periodic table, complexes of metals selected from Group I and Group II elements of the periodic table with anyone selected from 1,4-butandiol, ethylene glycol, polyethylene glycol, propylene glycol and a polyethylene glycol, or a combination thereof.

6. The toner supply roller of claim 5, wherein the ion-conductive agent is selected from $LiCF_3SO_3$, $LiAsF_6$, $LiBF_4$, $NaClO_4$, NaSCN, NaCl, KSCN and $Ca(ClO_4)_2$.

7. The toner supply roller of claim 2, wherein the nylon resin is present from about 5 parts per hundred (phr) to about 50 phr.

8. The toner supply roller of claim 1, wherein the ion-conductive agent is present from about 5 phr to about 30 phr.

* * * * *